US011388522B2

(12) United States Patent
Li et al.

(10) Patent No.: US 11,388,522 B2
(45) Date of Patent: Jul. 12, 2022

(54) SPEAKER MODULE

(71) Applicant: Goertek Inc., Shandong (CN)

(72) Inventors: Chengwei Li, Shandong (CN); Meng Chen, Shandong (CN); Zhenjun Li, Shandong (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 17/294,516

(22) PCT Filed: Dec. 27, 2018

(86) PCT No.: PCT/CN2018/124432

§ 371 (c)(1),
(2) Date: May 17, 2021

(87) PCT Pub. No.: WO2020/098101

PCT Pub. Date: May 22, 2020

(65) Prior Publication Data

US 2022/0030359 A1 Jan. 27, 2022

(30) Foreign Application Priority Data

Nov. 16, 2018 (CN) ..... 201811368266.6

(51) Int. Cl.
*H04R 9/06* (2006.01)
*H04R 9/02* (2006.01)
(Continued)

(52) U.S. Cl.
CPC ..... *H04R 9/06* (2013.01); *H04R 1/021* (2013.01); *H04R 1/1091* (2013.01); *H04R 9/02* (2013.01);
(Continued)

(58) Field of Classification Search
CPC .... H04R 1/021; H04R 1/1075; H04R 1/1091; H04R 9/02; H04R 9/06; H04R 2201/029;
(Continued)

(56) References Cited

U.S. PATENT DOCUMENTS 8,090,133 B2 * 1/2012 Yang ..... H04R 9/06 381/396
8,428,287 B2 * 4/2013 Rabu ..... H04R 1/1033 381/384

(Continued)

FOREIGN PATENT DOCUMENTS

CN 1794903 A 6/2006
CN 207475806 U 6/2018

*Primary Examiner* — Huyen D Le
(74) *Attorney, Agent, or Firm* — Baker Botts, LLP

(57) ABSTRACT

A speaker module comprising a module middle housing and a static electricity removal structure; the static electricity removal structure comprises a conductive plastic member, a metal insert connected to the conductive plastic member, a conductive steel sheet and a fixing component; the module middle housing is provided with a protruding part on an outer lateral wall thereof; the metal insert and the fixing component are injection molded on the protruding part; the conductive steel sheet is connected to the metal insert with one end thereof and is connected to a first portion of an external device with the other end thereof; the conductive plastic member is fixed onto the protruding part by a secondary injection molding; the metal insert is conductively connected to the fixing component by the conductive plastic member; the speaker module is disposed at a second portion of the external device of the fixing component.

10 Claims, 3 Drawing Sheets

(51) Int. Cl.
*H04R 1/10* (2006.01)
*H04R 1/02* (2006.01)

(52) U.S. Cl.
CPC .... *H04R 2201/029* (2013.01); *H04R 2400/03* (2013.01); *H04R 2400/11* (2013.01); *H04R 2499/11* (2013.01)

(58) Field of Classification Search
CPC ..... H04R 2201/107; H04R 2400/03; H04R 2400/11; H04R 2499/11; H01Q 1/273
See application file for complete search history.

(56) References Cited

U.S. PATENT DOCUMENTS

| | | | | |
|---|---|---|---|---|
| 9,301,053 | B2 * | 3/2016 | Guo | H04R 9/04 |
| 2015/0304776 | A1 * | 10/2015 | Backman | H04R 1/00 381/398 |

* cited by examiner

SPEAKER MODULE

CROSS-REFERENCE TO RELATED APPLICATIONS

This application is a National Stage of International Application No. PCT/CN2018/124432, filed on Dec. 27, 2018, which claims priority to Chinese Patent Application No. 201811368266.6, filed on Nov. 16, 2018, both of which are hereby incorporated by reference in their entireties.

TECHNICAL FIELD

The present invention relates to an electro-acoustic conversion device, and more specifically, to a speaker module provided with an external static electricity removal structure.

BACKGROUND

When an electronic device is in use, its internal components such as circuit boards, speaker housing or other parts, may generate weak current during use, and static electric charge will continue to accumulate. The static electric charge, if not discharged in time, is likely to cause damage to internal circuits or components or some fragile internal electronic parts due to high voltage generated and released when the static electric charge is accumulated to a considerable amount. The approach for removing static electricity in the prior art is essentially to weld a steel sheet outside the speaker housing and discharge the static electricity through the steel sheet, but this approach has the following problems:

Firstly, during welding of the steel sheet, the housing is likely to be damaged due to high temperature and thus has an impact on appearance thereof.

Secondly, it is not easy to determine welding position of the steel sheet and welding angle for the steel sheet. This may cause poor assembly accuracy and has an impact on product yield.

In addition, use of welding would leave welding marks after completion of assembly, and would result in a poor overall appearance.

Therefore, it is necessary to provide a new technical solution to solve the above technical problems.

SUMMARY

An objective of the present invention is to provide a new technical solution for a speaker module.

According to the first aspect of the invention, a speaker module is provided, comprising a module middle housing and a static electricity removal structure; the static electricity removal structure comprises a conductive plastic member, a metal insert connected to the conductive plastic member, a conductive steel sheet and a fixing component; the module middle housing is provided with a protruding part on an outer lateral wall thereof; the metal insert and the fixing component are injection molded on the protruding part; the conductive steel sheet is connected to the metal insert with one end thereof and is connected to a first portion of an external device with the other end thereof; the conductive plastic member is fixed onto the protruding part by means of secondary injection molding; the metal insert is conductively connected to the fixing component by means of the conductive plastic member; the speaker module is disposed at a second portion of the external device by means of the fixing component.

Preferably, the speaker module further comprises a module lower housing mounted on the module middle housing; the metal insert is injection molded on a surface of the protruding part close to the module lower housing and is connected to the conductive steel sheet.

Preferably, the conductive steel sheet protrudes outward with a part thereof to form a cantilever structure.

Preferably, the fixing member is a ring-shaped fixing washer.

Preferably, the fixing washer is fixed to the second portion by a bolt.

Preferably, the protruding part is of a cuboid structure, and comprises a first surface and a second surface which are oppositely arranged in a thickness direction, and a third surface and a fourth surface which are oppositely arranged on a side part; the metal insert is injection molded on the first surface; the fixing component is injection molded on the fourth surface; the second surface and the third surface are provided with grooves thereon for coupling the metal insert and the fixing component, and the conductive plastic member is injection molded in the grooves.

Preferably, the grooves and the conductive plastic member each have a U-shaped structure as a whole.

Preferably, the fixing component is located at a part of the fourth surface close to the first surface.

Preferably, the protruding part is formed with a cavity inside, and the cavity is in communication with a front acoustic cavity of the speaker module According to another aspect of the invention, an electronic device is provided, comprising a housing and the speaker module according to any one of above solutions, wherein the speaker module is located in the housing and is fixed to a second portion of the housing by the fixing component; the housing is the first portion and is connected to the conductive steel sheet.

The beneficial effects of the present invention are: with the conductive plastic parts installed on the protrusion part of the middle housing by secondary injection molding, the static electricity generated in the circuit boards and other parts inside the device is conducted through the fixed part, conductive plastic part, metal insert and conductive steel sheet in turn, and finally conducted to the outside of the device through the contact between the cantilever of the conductive steel sheet and the external device. This solution simplifies structure of the product and can optimize its appearance, thereby achieving the purpose of removing static electricity and improving yield of the product. In the prior art, the use of externally welded steel sheets will affect the accuracy and yield of the product. Therefore, the technical task to be achieved or the technical problem to be solved by the present invention has never been thought of or anticipated by those skilled in the art, so the present invention is a new technical solution.

Other features and advantages of the invention will become clear from the following detailed description of exemplary embodiments of the invention with reference to the drawings.

BRIEF DESCRIPTION OF THE DRAWINGS

The drawings incorporated in the specification and constituting a part of the specification show embodiments of the present invention, and together with the description thereof, serve to explain the principle of the present invention.

DETAILED DESCRIPTION

Figure 1:
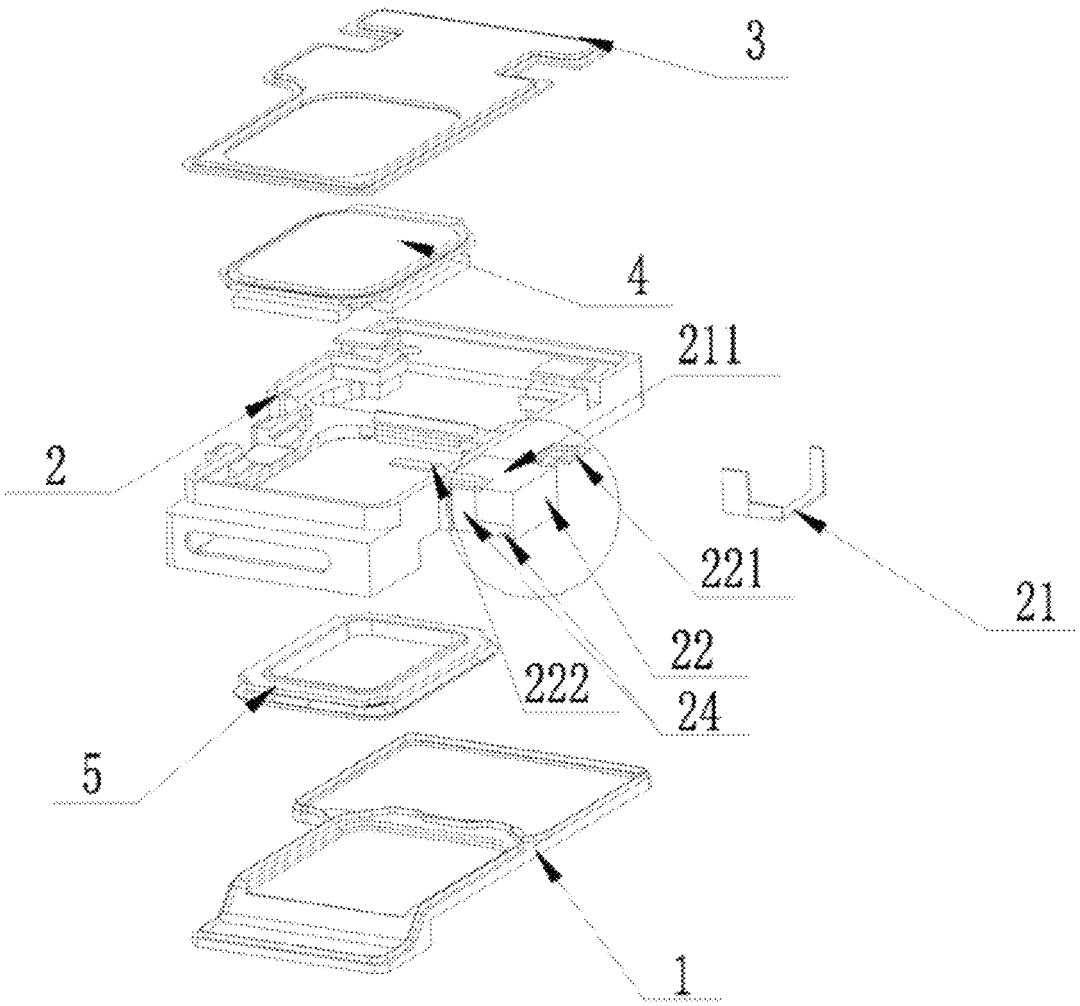
FIG. 1 is an exploded view of a speaker module according to an embodiment of the invention.

Various exemplary embodiments of the invention will now be described in detail with reference to the drawings. It should be needed that: unless specifically stated otherwise, the relative arrangement of components and steps, numerical expressions, and numerical values set forth in these embodiments do not limit the scope of the invention.

The following description of at least one exemplary embodiment is actually merely illustrative, and in no way serves as any limitation on the invention and its application or use.

The technologies, methods, and devices known to those of ordinary skill in the relevant fields may not be discussed in detail, but where appropriate, the technologies, methods, and devices should be regarded as part of the specification.

In all examples shown and discussed herein, any specific values should be interpreted as exemplary only and not as limitations. Therefore, other examples of the exemplary embodiment may have different values.

It should be noted that similar reference numerals and letters indicate similar items in the following figures, so once an item is defined in one figure, it does not need to be further discussed in subsequent figures.

Figure 2:
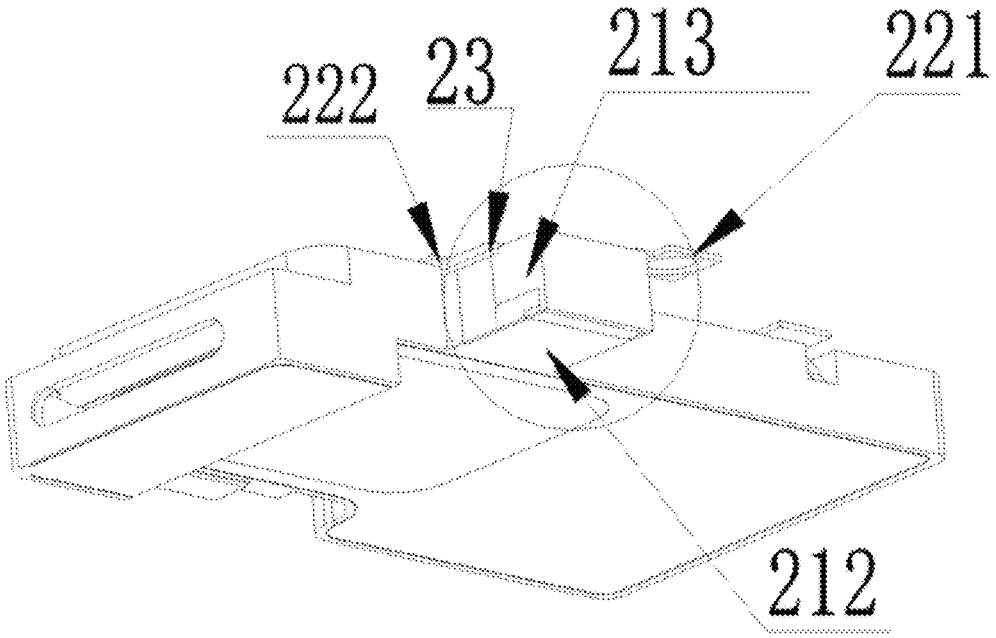
FIG. 2 is a schematic structure diagram of a protruding part of the speaker module according to the embodiment of the present invention.

Referring to FIGS. 1 and 2, a speaker module is provided in the present application, and comprises a module middle housing 2 and a static electricity removal structure; the static electricity removal structure comprises a conductive plastic member 21, a metal insert 23 connected to the conductive plastic member 21, a conductive steel sheet 222 and a fixing component 221, and the module middle housing 2 is provided with a protruding part 22 on an outer lateral wall thereof, and the metal insert 23 and the fixing component 221 are injection molded on the protruding part 22, and the conductive steel sheet 222 is connected to the metal insert 23 at an end thereof and is connected to a first portion of an external device at the other end thereof, and the conductive plastic member 21 is fixed onto the protruding part 22 by means of secondary injection molding, and the metal insert 23 is conductively conducted to the fixing component 221 by means of the conductive plastic member 21, and the speaker module is disposed at a second portion of the external device by means of the fixing component 221.

In the embodiment of the present invention, the static electricity removal structure may conduct the static electricity from the second portion inside the device to the conductive steel sheet 222 through the fixing component 221, the conductive plastic member 21 and the metal insert 23 mounted on the protrusion part 22. Since the conductive steel sheet 222 is connected to the first portion of the external device, the static electricity inside the device is conducted to the outside of the device.

The first portion refers to a part of the external device that may be in communication with the outside, that is, a part being used to conduct the static electricity out, such as the housing of the device; the second portion refers to a part where the static electricity may be easily generated within the device, such as circuit boards in the device, and where the static electricity is generated and then conducted through the fixing component 221.

The conductive plastic member 21 used in the embodiments of the present invention is directly arranged on the protruding part 22 by means of secondary injection molding. That is, during processing, the conductive plastic member 21 is fixed on the protruding part 22 of the middle housing 2 by means of secondary injection molding, and subsequent installation steps are not required, so that the production process of the device is simplified. Meanwhile, it can well control the position and shape of the conductive plastic member 21 by using the mold during injection molding, and compared with the method of welding the steel sheet, it can produce products with high precision and may effectively improve the yield of products.

In addition, in an embodiment of the present invention, it further includes a module upper housing 1 and a module lower housing 3 installed on both sides of the module middle housing 2, a diaphragm assembly 5 arranged between the module upper housing 1 and the module middle housing 2, and a magnetic circuit assembly 4 arranged between the module middle housing 2 and the module lower housing 3.

Figure 3:
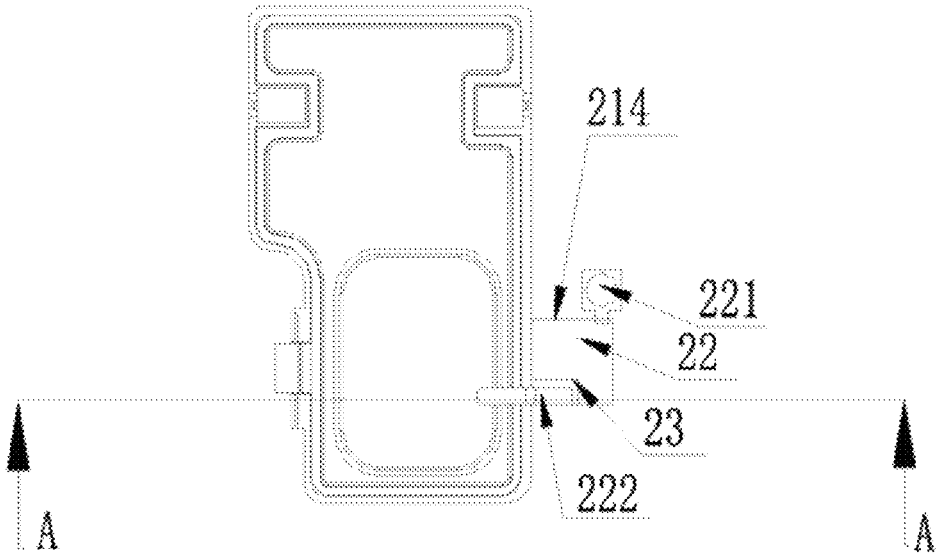
FIG. 3 is a top view of a speaker module according to an embodiment of the present invention.

In an alternative embodiment of the present invention, referring to FIG. 3, it further includes a module lower housing 3 mounted on the module middle housing 2, and the metal insert 23 is injection molded on a surface of the protruding part 22 close to the module lower housing 3, and the conductive steel sheet 222 is connected to the metal insert 23. The metal insert 23 and the conductive steel sheet 222 herein work together to couple the conductive plastic member 21 with the first portion of the device.

Figure 4:
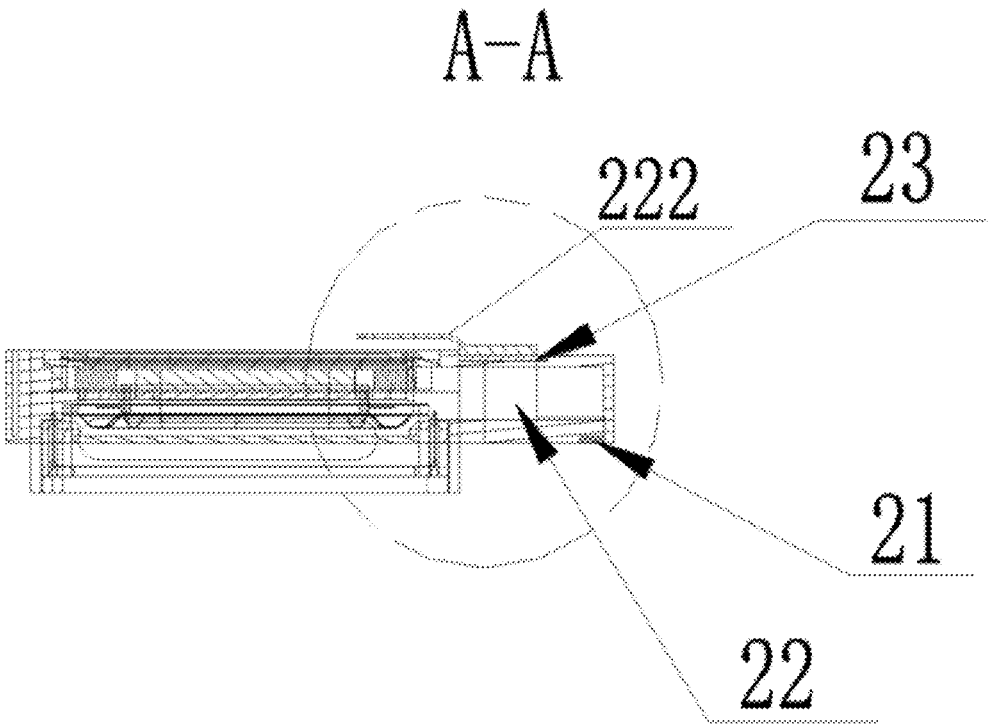
FIG. 4 is a cross-sectional view of the speaker module according to the embodiment of the present invention along the line A-A.
Figure 5:
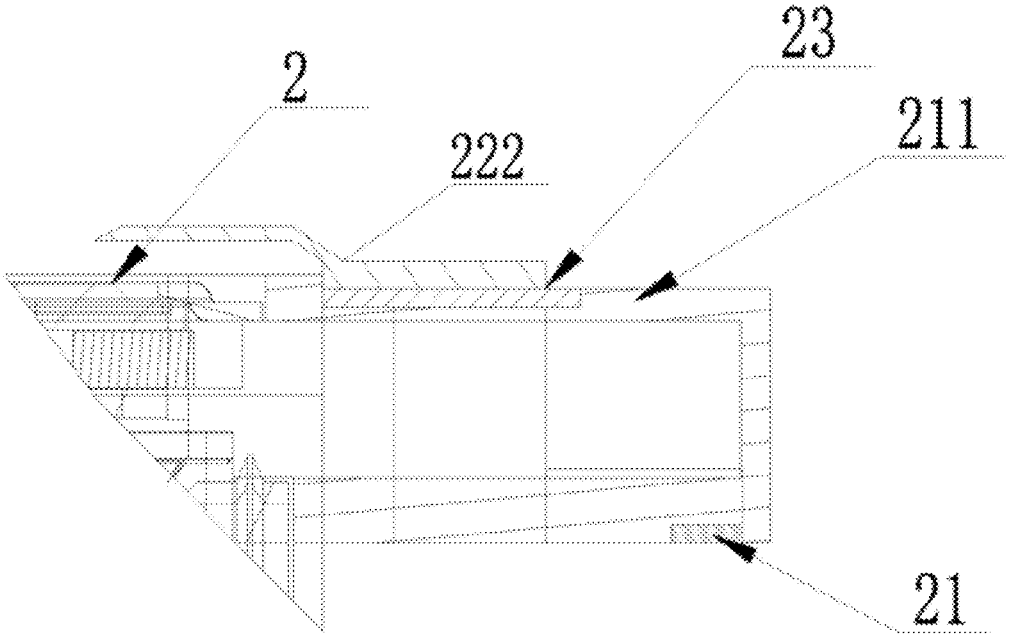
FIG. 5 is an enlarged schematic diagram of a part of details of FIG. 4.

Further, referring to FIGS. 4 and 5, a part of the conductive steel sheet 222 protrudes outward to form a cantilever structure. That is, the conductive steel sheet 222 is connected to the metal insert 23 at an end thereof, and has a free end and extending outward at the other end thereof, so as to form a cantilever structure which is connected to the first portion of the external device. The cantilever structure may be better connected with the first portion, and can conduct the static electricity more fully.

In another optional embodiment of the present invention, the fixing component 221 is a ring-shaped fixing washer, and the fixing washer is fixed to the second portion by a bolt. The fixing washer is configured to conduct the static electricity in the second portion within the device to the conductive plastic member 21.

In addition, as long as the fixing component 221 can fix the speaker and achieve conduction, its shape is not limited to a ring shape. The connection method of the fixing component 221 and the second portion is not limited to bolt connection, but may also be bonding or any other connection method that can realize the fixing of the two.

In another optional embodiment of the present invention, referring to FIGS. 2 and 3, the protruding part 22 is of a cuboid structure, and the protruding part 22 includes a first surface 211 and a second surface 212 that are oppositely arranged in a thickness direction, and the third surface 213 and the fourth surface 214 that oppositely arranged on side parts. For example, the first surface 211 is a surface of the protruding part 22 that is close to the module lower housing 3.

The metal insert 23 is injection molded on the first surface 211, the fixing component 211 is injection molded on the fourth surface 214, the second surface 212 and the third surface 213 are provided with grooves 24 for connecting the metal insert and the fixing component, and the conductive plastic member 21 is injection molded in the groove 24.

The metal insert 23 and the fixing component 221 are respectively arranged on different surfaces of the protruding part 22. On the one hand, it is convenient for the installation of all components, and on the other hand, the parts are scattered so that the whole structure is not too crowded. The metal insert 23 and the fixing component 221 are connected together by the conductive plastic member 21 being injection molded in the grooves 24 to realize the communication between the two. The shape and tendency of the groove 24 may be of, but not limited to, a linear groove, as long as the communication function can be achieved.

The tendency and shape of the groove 24 can be set according to the actual equipment and the internal structural layout of requirements. The conductive plastic member 21 is injection molded into the groove 24 by secondary injection molding, and the shape thereof is determined by the shape and tendency of the groove 24, as long as the metal insert 23 and the fixing component 221 may be conducted each other.

Further, in one of the optional solutions of the present invention, the grooves 24 are each integrally formed as a U-shaped structure, and one side of the conductive plastic member is integrally formed as a U-shaped structure. The fixing component 221 is located at a part of the fourth surface 214 close to the first surface 211. In this case, the fourth surface 214 is also provided with a groove 24 for coupling the groove on the third surface with the fixing component 221. The U-shaped structure is designed to connect the metal inserts on the first surface and the fixing parts on the fourth surface, which are located at a further distance, at a short distance. With this shape, the raw materials can be saved to a large extent, and it is also more convenient in production and processing.

In an optional embodiment of the present invention, the protruding part 22 is formed with a cavity inside, and the cavity is in communication with a front acoustic cavity of the speaker module. The cavity inside the protruding part 22 is in communication with a front acoustic cavity of the speaker. As a resonant cavity, the cavity can play a role in optimizing the high frequency performance of the speaker module.

In another technical solution of the present invention, an electronic device is provided. The electronic device may be, but not limited to, a mobile phone, a tablet computer, a laptop, a game console, an intercom, or the like.

The electronic device comprises a housing and the above-mentioned speaker module located in the housing and fixed to a second portion of the housing by the fixing component, and the housing is the first portion, and the conductive steel sheet is connected to the housing.

Although some specific embodiments of the present invention have been described in detail through examples, those skilled in the art should understand that the above examples are only for illustration and not for limiting the scope of the present invention. It should be understood by a person skilled in the art that the above embodiments can be modified without departing from the scope and spirit of the present invention. The scope of the present invention is defined by the attached claims.

The invention claimed is:

1. A speaker module, comprising a module middle housing and a static electricity removal structure; wherein the static electricity removal structure comprises a conductive plastic member, a metal insert connected to the conductive plastic member, a conductive steel sheet and a fixing component; the module middle housing being provided with a protruding part on an outer lateral wall thereof; wherein the metal insert and the fixing component are injection molded on the protruding part; the conductive steel sheet is connected to the metal insert with a first end thereof and is connected to a first portion of an external device with a second end thereof; the conductive plastic member is fixed onto the protruding part by a secondary injection molding; the metal insert is conductively connected to the fixing component by the conductive plastic member; and the speaker module is disposed at a second portion of the external device by the fixing component.

2. The speaker module of claim 1, further comprising a module lower housing mounted on the module middle housing, wherein the metal insert is injection molded on a surface of the protruding part proximate to the module lower housing, and is connected to the conductive steel sheet.

3. The speaker module of claim 2, wherein the conductive steel sheet protrudes outward with a part thereof to form a cantilever structure.

4. The speaker module of claim 1, wherein the fixing member is a ring-shaped fixing washer.

5. The speaker module of claim 4, wherein the fixing washer is fixed to the second portion by a bolt.

6. The speaker module of claim 1, wherein the protruding part is of a cuboid structure, and comprises a first surface and a second surface which are oppositely arranged in a thickness direction, and a third surface and a fourth surface which are oppositely arranged on a side part; the metal insert is injection molded on the first surface; the fixing component is injection molded on the fourth surface; the second surface and the third surface are provided with grooves thereon for coupling the metal insert and the fixing component, and the conductive plastic member is injection molded in the grooves.

7. The speaker module of claim 6, wherein the grooves are each integrally formed as a U-shaped structure, and one side of the conductive plastic member is integrally formed as a U-shaped structure.

8. The speaker module of claim 6, wherein the fixing component is located at a part of the fourth surface close to the first surface.

9. The speaker module of claim 1, wherein the protruding part is formed with a cavity inside, and the cavity is in communication with a front acoustic cavity of the speaker module.

10. An electronic device, comprising a housing and the speaker module of claim 1, wherein the speaker module is located in the housing and is fixed to a second portion of the housing by the fixing component; the housing is the first portion and is connected to the conductive steel sheet.

* * * * *